US010532566B2

(12) United States Patent
Kurokawa

(10) Patent No.: US 10,532,566 B2
(45) Date of Patent: Jan. 14, 2020

(54) INKJET RECORDING APPARATUS

(71) Applicant: KYOCERA Document Solutions Inc., Osaka (JP)

(72) Inventor: Yuichiro Kurokawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 38 days.

(21) Appl. No.: 15/821,027

(22) Filed: Nov. 22, 2017

(65) Prior Publication Data

US 2018/0141333 A1 May 24, 2018

(30) Foreign Application Priority Data

Nov. 24, 2016 (JP) ..... 2016-228067

(51) Int. Cl.

| | |
|---|---|
| ***B41J 2/045*** | (2006.01) |
| ***B41J 2/21*** | (2006.01) |
| ***B41J 11/00*** | (2006.01) |
| ***B41J 2/145*** | (2006.01) |

(52) U.S. Cl.

CPC ..... *B41J 2/04545* (2013.01); *B41J 2/04581* (2013.01); *B41J 2/145* (2013.01); *B41J 2/2146* (2013.01); *B41J 11/008* (2013.01); *B41J 11/009* (2013.01); *B41J 11/0095* (2013.01)

(58) Field of Classification Search

CPC .... B41J 29/393; B41J 2/04581; B41J 11/008; B41J 11/0095; B41J 29/38; B41J 2/2146; B41J 11/009; B41J 2/145; B41J 2/04545

USPC ..... 347/9, 10, 12, 14, 19, 101, 180

See application file for complete search history.

(56) References Cited

U.S. PATENT DOCUMENTS

| | | | | |
|---|---|---|---|---|
| 6,753,975 | B1 | 6/2004 | Hanson | 358/1.18 |
| 2005/0200680 | A1* | 9/2005 | Uchida | B41J 11/0065 347/104 |
| 2009/0251499 | A1 | 10/2009 | Santo et al. | 347/9 |
| 2012/0081726 | A1* | 4/2012 | Nakamaru | G06K 15/022 358/1.12 |

FOREIGN PATENT DOCUMENTS

| | | | |
|---|---|---|---|
| JP | 03-86576 | A | 4/1991 |
| JP | 2001-96874 | A | 4/2001 |
| JP | 2001-138597 | A | 5/2001 |
| JP | 2002-331648 | A | 11/2002 |
| JP | 2009-241281 | A | 10/2009 |

OTHER PUBLICATIONS

Japanese Office Action dated Jul. 2, 2019, issued by the Japanese Patent Office in corresponding application JP 2016-228067.

* cited by examiner

*Primary Examiner* — Jannelle M Lebron
(74) *Attorney, Agent, or Firm* — Stein IP, LLC

(57) ABSTRACT

An inkjet recording apparatus includes a shape reading unit that reads a shape of a conveyed recording medium, a line data generating unit that generates line data based on information of the shape of the recording medium read by the shape reading unit, a head unit that ejects ink to the conveyed recording medium, a mask data generating unit that specifies an ejection inhibition part to which ink is not ejected from each of the plurality of line data, and a print image data generating unit that combines the dot image data and the mask data so as to generate print image data.

7 Claims, 10 Drawing Sheets

Line Data

| Area | Ar1 | Ar2 | Ar3 | Ar4 | Ar5 | Ar6 | Ar7 | Ar8 | Ar9 | Ar10 | Ar11 | Ar12 |
|---|---|---|---|---|---|---|---|---|---|---|---|---|
| Area Value | 1 | 1 | 1 | 0 | 0 | 0 | 0 | 0 | 0 | 1 | 1 | 1 |

Fig.9

Line Database

| | Ar1 | Ar2 | Ar3 | Ar4 | Ar5 | Ar6 | Ar7 | Ar8 | Ar9 | Ar10 | Ar11 | Ar12 |
|---|---|---|---|---|---|---|---|---|---|---|---|---|
| n-4 | 1 | 1 | 1 | 1 | 1 | 1 | 1 | 1 | 1 | 1 | 1 | 1 |
| n-3 | 1 | 1 | 1 | 1 | 1 | 1 | 1 | 1 | 1 | 1 | 1 | 1 |
| n-2 | 1 | 1 | 1 | 1 | 1 | 1 | 1 | 1 | 1 | 1 | 1 | 1 |
| n-1 | 1 | 1 | 1 | 1 | 1 | 1 | 1 | 1 | 1 | 1 | 1 | 1 |
| n | 1 | 1 | 1 | 1 | 1 | 1 | 1 | 1 | 1 | 1 | 1 | 1 |
| n+1 | 1 | 1 | 1 | 1 | 0 | 0 | 0 | 1 | 1 | 1 | 1 | 1 |
| n+2 | 1 | 1 | 1 | 0 | 0 | 0 | 0 | 0 | 1 | 1 | 1 | 1 |
| n+3 | 1 | 1 | 1 | 1 | 1 | 1 | 1 | 1 | 1 | 1 | 1 | 1 |
| n+4 | 1 | 1 | 1 | 1 | 1 | 1 | 1 | 1 | 1 | 1 | 1 | 1 |

Fig.10

Line Database

| | Ar1 | Ar2 | Ar3 | Ar4 | Ar5 | Ar6 | Ar7 | Ar8 | Ar9 | Ar10 | Ar11 | Ar12 |
|---|---|---|---|---|---|---|---|---|---|---|---|---|
| n-2 | 1 | 1 | 1 | 1 | 1 | 1 | 1 | 1 | 1 | 1 | 1 | 1 |
| n-1 | 1 | 1 | 1 | 1 | 1 | 1 | 1 | 1 | 1 | 1 | 1 | 1 |
| n | 1 | 1 | 1 | 1 | 1 | 1 | 1 | 1 | 1 | 1 | 1 | 1 |
| n+1 | 1 | 1 | 1 | 1 | 0 | 0 | 0 | 1 | 1 | 1 | 1 | 1 |
| n+2 | 1 | 1 | 1 | 0 | 0 | 0 | 0 | 0 | 1 | 1 | 1 | 1 |

AND Operation

Mask Data

| | Ar1 | Ar2 | Ar3 | Ar4 | Ar5 | Ar6 | Ar7 | Ar8 | Ar9 | Ar10 | Ar11 | Ar12 |
|---|---|---|---|---|---|---|---|---|---|---|---|---|
| n | 1 | 1 | 1 | 0 | 0 | 0 | 0 | 0 | 1 | 1 | 1 | 1 |

INKJET RECORDING APPARATUS

INCORPORATION BY REFERENCE

This application is based upon and claims the benefit of priority from the corresponding Japanese Patent Application No. 2016-228067 filed Nov. 24, 2016, the entire contents of which are hereby incorporated by reference.

BACKGROUND

The present disclosure relates to an inkjet recording apparatus that records images by ejecting ink to a recording medium.

The inkjet recording apparatus ejects ink from a head unit to the recording medium so that an image is formed on a paper sheet. The inkjet recording apparatus has a print range having a constant length in a conveying direction of the recording medium, and conveys the recording medium by the constant length every time when finishing printing in the print range so as to form an image.

In the inkjet recording apparatus, in case where ink is ejected to a part without a recording medium, inside of the inkjet recording apparatus may be contaminated with ink, and hence a recording medium may be contaminated in printing afterward.

In order to solve such a problem, for example, a recording head is provided with an infrared sensor, and printing is performed while detecting presence or absence of a paper sheet by the infrared sensor. Further, printing is not performed using a mask in a part that is determined to be without a paper sheet.

However, for example, in a case where a hole is formed in a middle part of the paper sheet, the mask is not formed, and hence ink passes through the hole and is ejected below the paper sheet. Then, the inside of the apparatus may be contaminated, and hence a recording medium may be contaminated in printing afterward.

SUMMARY

An inkjet recording apparatus according to the present disclosure includes a shape reading unit, a line data generating unit, a head unit, a mask data generating unit, and a print image data generating unit. The shape reading unit reads a shape of a conveyed recording medium by dividing it into read lines, each of which has a certain length in a conveying direction of the recording medium and has a plurality of areas divided in a direction perpendicular to the conveying direction. The line data generating unit generates line data based on information of the shape of the recording medium read by the shape reading unit. The head unit ejects ink to the recording medium conveyed to a print range having a predetermined length in the conveying direction. The mask data generating unit specifies an ejection inhibition part to which ink is not ejected from each of the plurality of line data generated continuously, so as to generate mask data in which information of all the specified ejection inhibition parts is added to one line data. The print image data generating unit combines the dot image data and the mask data so as to generate print image data in which a location to which the head unit does not eject ink is specified with respect to the dot image data.

Further features and advantages of the present disclosure will become more apparent from the description of embodiments given below.

BRIEF DESCRIPTION OF THE DRAWINGS

FIG. 9 is a diagram showing database of line data of the paper sheet shown in FIG. 8.

FIG. 10 is a diagram showing a procedure for generating n-th mask data based on the line data shown in FIG. 9.

DETAILED DESCRIPTION

Hereinafter, with reference to the drawings, a printer 100 (corresponding to an inkjet recording apparatus) having a fixed type head unit 4 is exemplified and described as an inkjet recording apparatus. Elements such as a structure and a layout described in the embodiment of the present disclosure are merely examples and should not be interpreted as limitations of the scope of the disclosure.

(Outline of Printer 100)

Figure 1:
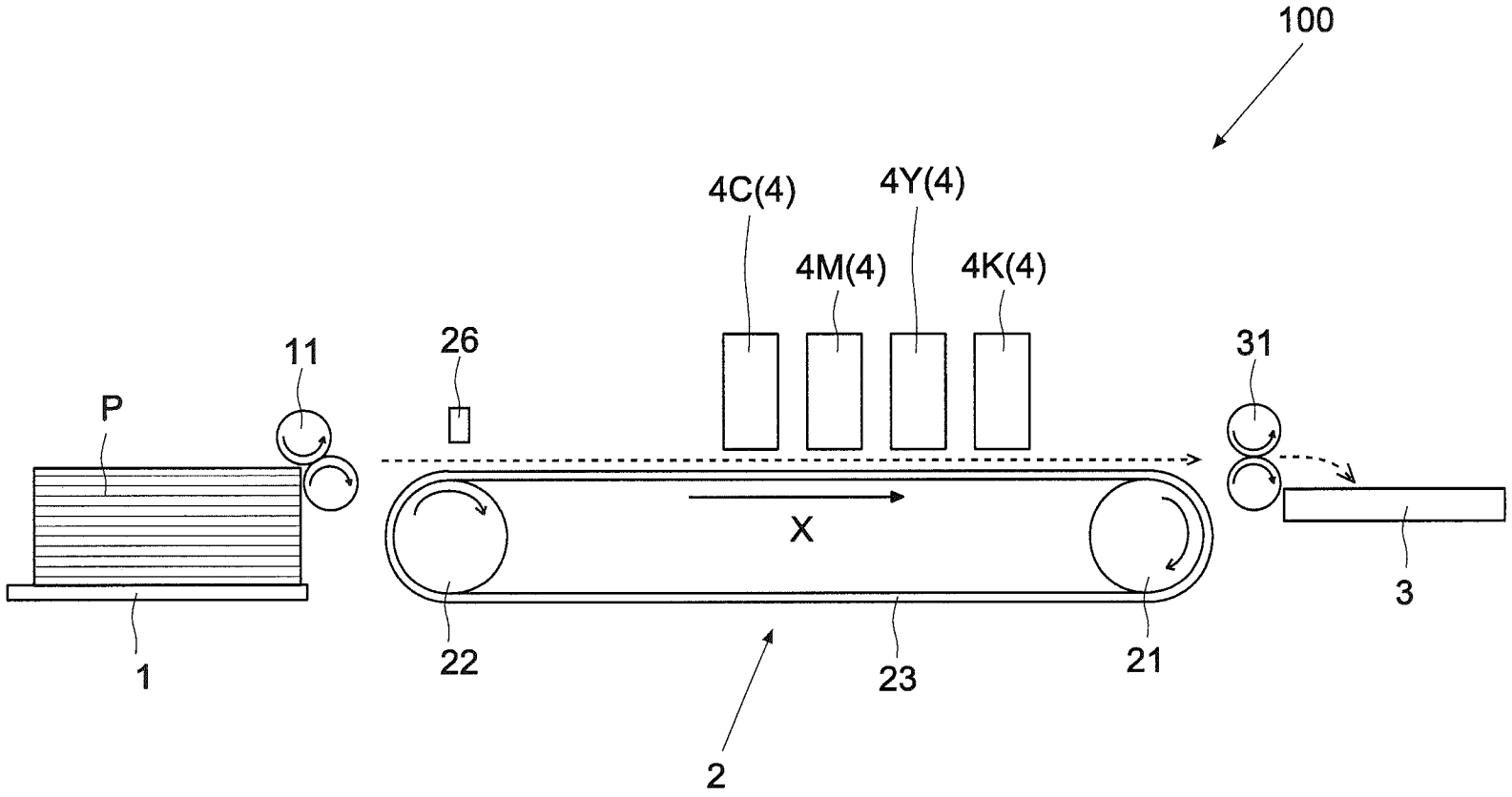
FIG. 1 is a layout diagram showing a schematic structure of a printer.
Figure 2:
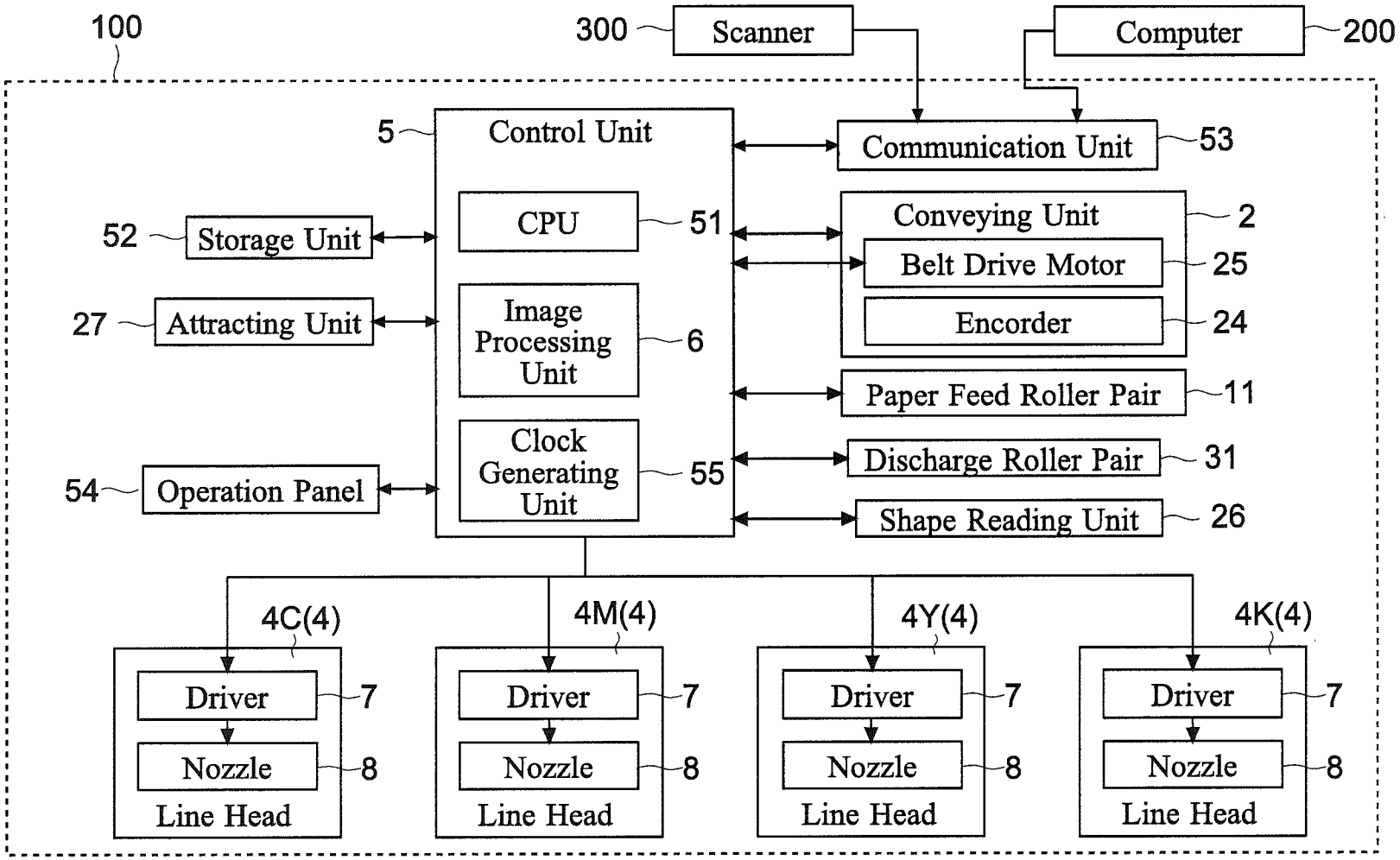
FIG. 2 is a block diagram showing an example of a hardware structure of the printer.

First, with reference to FIG. 1, an outline of the printer 100 according to the embodiment of the present disclosure is described. FIG. 1 is a layout diagram showing a schematic structure of the printer 100. FIG. 2 is a block diagram showing an example of a hardware structure of the printer 100. Note that in the following description, directions of up, down, right, and left are based on the state shown in FIG. 1, unless otherwise noted.

As shown in FIG. 1, a paper feed tray 1 is disposed on the left side of the printer 100. The paper feed tray 1 loads and stores paper sheets P (corresponding to recording media). A paper feed roller pair 11 is disposed at an end of the paper feed tray 1 on the downstream side in a sheet conveying direction. The paper feed roller pair 11 sends out the stored paper sheets P in turn from the top paper sheet P to a conveying unit 2.

The conveying unit 2 is disposed on the downstream side in the sheet conveying direction (the right side in FIG. 1) of the paper feed roller pair 11. The conveying unit 2 includes a drive roller 21, a follower roller 22 having an axis parallel to that of the drive roller 21, and a conveyor belt 23 stretched around the drive roller 21 and the follower roller 22. The drive roller 21 rotates by a driving force received from a belt drive motor 25 (see FIG. 2). The conveyor belt 23 turns when the drive roller 21 rotates. In this way, the paper sheet P on the conveyor belt 23 is conveyed in a direction of an arrow X in FIG. 1. In other words, the direction of the arrow X is a conveying direction of the paper sheet P. In addition, a discharge roller pair 31 for discharging the paper sheet P with a recorded (printed) image is disposed on the downstream side in the sheet conveying direction of the conveyor belt 23. In addition, the discharge roller pair 31 discharges the printed paper sheet P to a discharge tray 3.

Further, the head unit 4 for recording (printing) images on the conveyed paper sheets P is disposed. Specifically, a head unit 4C that ejects cyan ink, a head unit 4M that ejects magenta ink, a head unit 4Y that ejects yellow ink, and a head unit 4K that ejects black ink are arranged in order from an upstream side in the sheet conveying direction above the conveyor belt 23 between the paper feed roller pair 11 and the discharge roller pair 31. These head units 4C to 4K are filled with ink of four different colors (cyan, magenta, yellow, and black), respectively. Further, the head units 4C to 4K eject their respective color ink so that a color image is recorded (printed) on the paper sheet P. Note that this embodiment of the present disclosure describes an example where the four color head units 4 are disposed, but it is possible to add another color head unit 4. The head units 4C to 4K have the same structure and may be referred to simply as the head unit 4 without a symbol indicating the color (C, M, Y, or K) in the common description below.

(Hardware Structure)

Next, with reference to FIG. 2, an example of a hardware structure of the printer 100 according to the embodiment is described. FIG. 2 is a block diagram showing an example of the hardware structure of the printer 100.

First, the printer 100 is provided with a control unit 5 that controls a recording operation (printing operation). Note that the control unit 5 may be divided into a plurality of control units corresponding to functions or processing contents, such as a main control unit that performs overall control and image processing, an engine control unit that performs image recording and turning on and off motors for rotating various rotating members, and an image processing control unit that performs image processing.

The control unit 5 is provided with a CPU 51 as a central processing unit, for example. Further, the control unit 5 is connected to a storage unit 52 in a communicable manner. For example, the storage unit 52 includes nonvolatile and volatile storage devices, which are a read only memory (ROM), a random access memory (RAM), a hard disk drive (HDD), and a flash ROM. The storage unit 52 stores control programs, control data, image data, and the like. The CPU 51 performs calculation or the like based on the control programs and control data stored in the storage unit 52 so as to supply control signals to individual portions of the printer 100.

In addition, the control unit 5 is connected to a communication unit 53. The communication unit 53 is connected in a communicable manner to an external computer 200 (e.g. a personal computer or a server) and a scanner 300 that reads images recorded on the paper sheet P so as to generate image data, via a network, a cable, or the like. The communication unit 53 includes various connectors, a socket, a controller for communication control, a chip, a memory, and the like. Further, the communication unit 53 receives print data for making the printer 100 to print (e.g. data containing image data, setting data for printing, and the like) from the external computer 200 or the scanner 300. When the communication unit 53 receives the print data, the control unit 5 controls the head units 4, the conveying unit 2, and the like to work based on the print data so that printing is performed.

An image processing unit 6 performs various image processing on various image data such as the image data received from the computer 200, the image data stored in the storage unit 52, and the like. Note that there are a large variety of image processing that can be performed by the image processing unit 6. It is supposed that the image processing unit 6 can perform known image processing, and description of each image processing is omitted for convenience sake. Further, the image processing unit 6 finally converts the image data indicating contents to be printed on the paper sheet P into print image data, which indicates presence or absence of dot formation (ink ejection) and ink ejection amount for each pixel (each dot). The image processing unit 6 adjusts the print image data corresponding to a position of a nozzle 8 of each color in the sheet conveying direction and transmits control data (described later in detail) to a driver 7 of each head unit 4. Note that it is possible to functionally realize the image processing unit 6 by the CPU 51 of the control unit 5, the storage unit 52, and a program.

The control unit 5 (image processing unit 6) is connected to each head unit 4 and instructs each head unit 4 to operate. Each head unit 4 is provided with the driver 7 that actually controls ink ejection from each nozzle 8. The drivers 7 make the nozzles 8 eject simultaneously at a constant period. In addition, each driver 7 adjusts presence or absence of ink ejection from each nozzle 8 and the amount of ejected ink based on adjusted dot data, and controls gradation of dots (dot area) formed on the recording medium. For example, each driver 7 adjusts presence or absence of ink ejection and the ejection amount by changing drive voltage applied to each nozzle 8 and a drive pulse width based on an instruction from the control unit 5.

In addition, as shown in FIG. 2, the control unit 5 is connected to individual portions such as the paper feed roller pair 11, the conveying unit 2, the discharge roller pair 31, and an operation panel 54, which constitute the printer 100. Further, the control unit 5 controls and instructs operations of the individual portions. For example, the operation panel 54 includes hardware keys (not shown) and a display unit with a touch panel, which displays software keys (not shown). The operation panel 54 receives an input made by pressing a hardware key or a software key. The operation panel 54 recognizes input content and transmits data indicating the input content to the control unit 5. The control unit 5 controls each portion to operate according to the input content.

An encoder 24 of the conveying unit 2 is connected to the drive roller 21 or the follower roller 22 around which the conveyor belt 23 is stretched. The encoder 24 outputs a pulse corresponding to a rotational displacement (rotation angle) of a rotation shaft of the drive roller 21 or the follower roller 22 (e.g. one pulse per fraction of one turn or per half turn, which can be arbitrarily set). The control unit 5 counts the number of pulses transmitted from the encoder 24 and grasps a convey amount of the paper sheet P from a rotation amount of the drive roller 21 or the follower roller 22. In addition, the control unit 5 grasps a rotation speed of the belt drive motor 25 based on a period of the signal from the encoder 24 and controls rotation speed of the belt drive motor 25 so that the convey speed of the paper sheet becomes constant. Further, the control unit 5 controls the conveying unit 2 to convey the paper sheet P so that the paper sheet P is conveyed by one dot with respect to one ink ejection from the nozzle 8.

(Structure of Shape Reading Unit 26)

Figure 3:
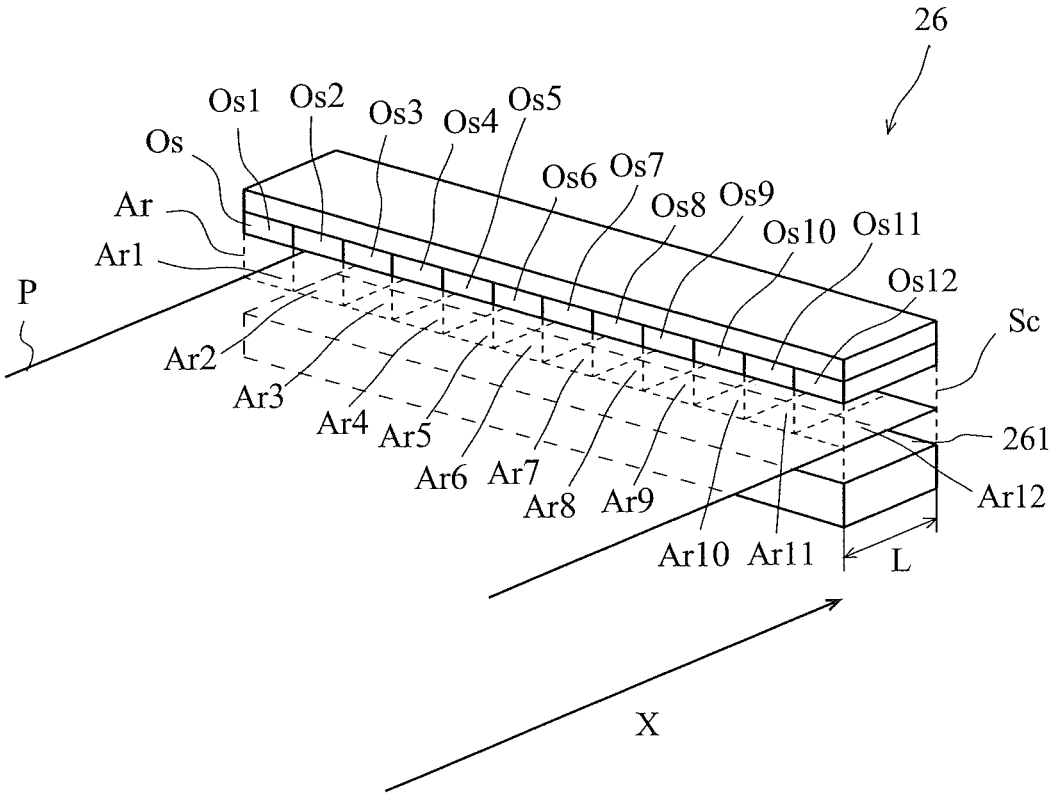
FIG. 3 is a schematic diagram of a shape reading unit for detecting a shape of a paper sheet.

Next, with reference to FIG. 3, an example of a shape reading unit 26 that detects a shape of the paper sheet P in the printer 100 according to the embodiment is described. FIG. 3 is a schematic diagram of the shape reading unit 26 that detects a shape of the paper sheet P.

As shown in FIG. 1, the shape reading unit 26 is disposed on the upstream side of the head unit 4 in the conveying direction of the paper sheet P. In this way, the shape reading unit 26 reads shape of the paper sheet P before being conveyed to the head unit 4.

As shown in FIG. 3, the shape reading unit 26 includes a light source 261 arranged in a direction perpendicular to the conveying direction of the paper sheet P (hereinafter referred to as a main scanning direction), and an optical sensor Os arranges to face the light source 261 with a space therebetween in which the paper sheet P is conveyed. In other words, it includes the light source 261 arranged in a direction perpendicular to the conveying direction of the paper sheet P and the optical sensor Os. Further, in the shape reading unit 26, a gap between the light source 261 and the optical sensor Os is a detection range Sc for detecting the paper sheet P. The detection range Sc has a constant length in the conveying direction of the paper sheet P (referred to as length L). Further, the shape reading unit 26 has a structure for sequentially detecting shape of the paper sheet P conveyed in detection range Sc. In other words, the shape reading unit 26 detects the paper sheet P every length L divided in the conveying direction. Note that a size of the paper sheet P that can be detected by one operation of the shape reading unit 26 is referred to as one line.

In the shape reading unit 26, a plurality of optical sensors Os are arranged in the main scanning direction (in this example, 12 optical sensors Os1 to Os12). Each optical sensor Os can detect a shape of the opposed paper sheet P. In other words, the shape reading unit 26 divides one line into a plurality of areas (which is areas Ar1 to Ar12) and detects a shape of each area Ar of the paper sheet P by one optical sensor Op. Note that the length L of one line and the length of the area Ar in the main scanning direction are not limited to specific values, but they are preferably multiplications of a dot width. Note that in the following description, areas detected by the optical sensors Os1 to Os12 are referred to as areas Ar1 to Ar12, respectively.

For example, the optical sensor Os facing the area Ar in which the paper sheet P does not exist detects light emitted from the light source. The optical sensor Os facing the area Ar in which the paper sheet P exists does not detect light or detects little light emitted from the light source because the light emitted from the light source is blocked by the paper sheet P. The optical sensor Os outputs a signal that is different depending on input light intensity.

Further, the shape reading unit 26 is connected to the control unit 5. On the basis of the signals from the optical sensors Os of the shape reading unit 26, the shape of one line of the paper sheet P conveyed in the detection range Sc is transmitted to the control unit 5. The control unit 5 generates line data indicating the shape of one line of the paper sheet P based on the signals from the shape reading unit 26. Note that details of the line data will be described later.

In addition, the control unit 5 sets time determined for each head unit 4 based on a distance from the shape reading unit 26 to a position of the nozzle 8 of each head unit 4 and the convey speed of the paper sheet P. When the time determined for each head unit 4 is measured, the control unit 5 controls each head unit 4 to start ink ejection. In other words, when the time necessary for conveying the paper sheet P from the shape reading unit 26 to each nozzle 8 elapses after the front end of the paper sheet P is detected, the control unit 5 controls each head unit 4 to start ink ejection (start of printing first page).

An attracting unit 27 applies a voltage to the follower roller 22 on a paper feed side based on a signal from the control unit 5, so that the conveyor belt 23 attracts the paper sheet P in an electrostatic manner (or may inhale the same). Release of the electrostatic attraction is performed when the attracting unit 27 is grounded based on an instruction from the control unit 5.

(Mechanism of Ink Ejection Control)

Figure 4:
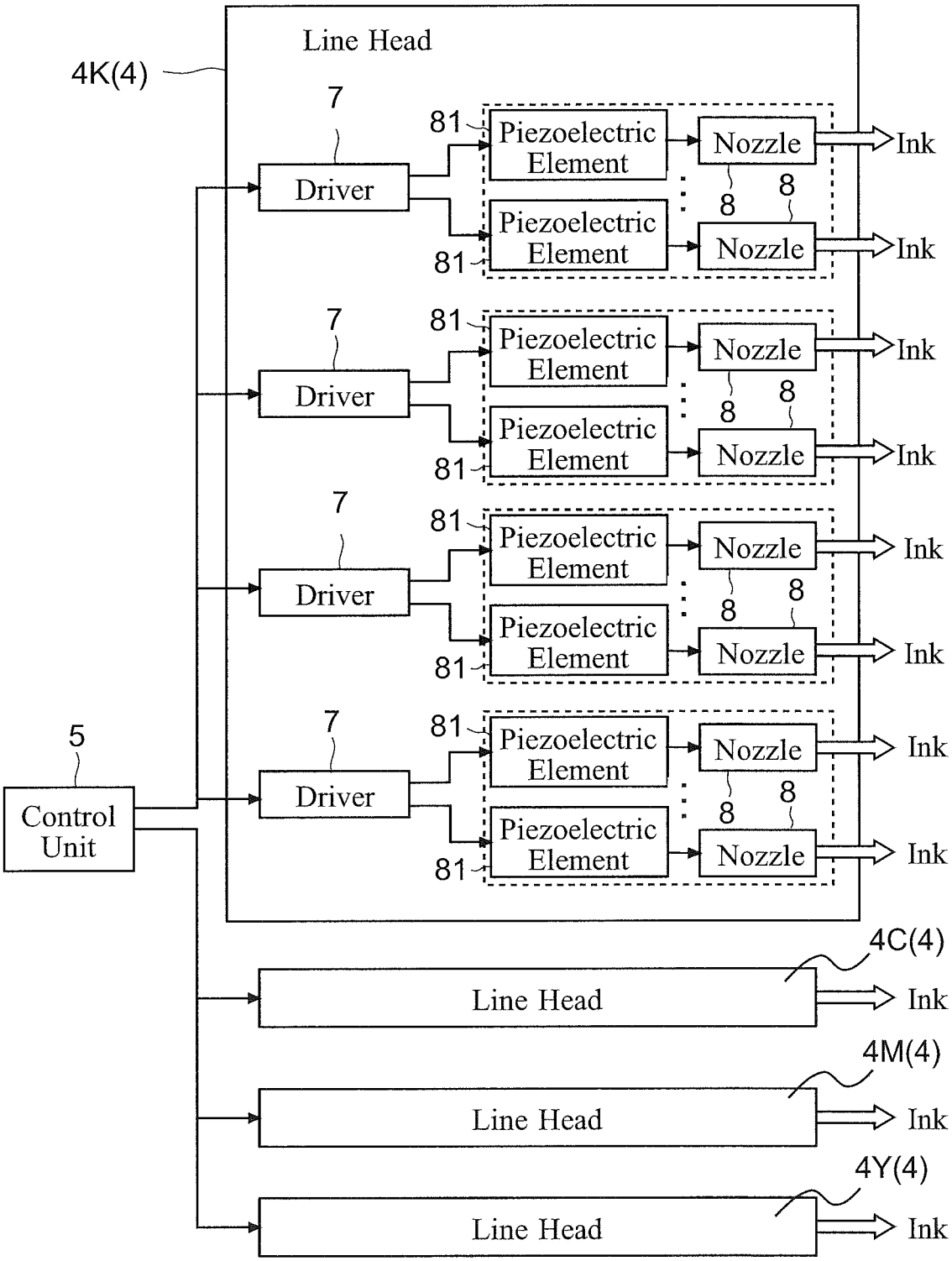
FIG. 4 is a block diagram showing an example of a mechanism related to ink ejection.

Next, with reference to FIG. 4, an example of a mechanism related to ink ejection in the printer 100 according to the embodiment is described. FIG. 4 is a block diagram showing an example of a mechanism related to ink ejection.

Each head unit 4 (4C to 4K) includes a plurality of nozzles 8, one piezoelectric element 81 (such as a PZN) for each nozzle 8, and a plurality of drivers 7 for applying a voltage to each piezoelectric element 81 so as to actually control the ink ejection. Depending on a paper sheet size that can be printed on the specification, 2500 (2500 dots of) nozzles 8 are provided to each head unit 4, for example. Note that the number of nozzles 8 provided to each head unit 4 may be less than 2500 or more than 2500. Note that a part of internal structure of only one head unit 4K among the head units 4 is shown in FIG. 4 for convenience sake, but the head units 4 have basically the same structure, and illustration of other head units is omitted.

Each nozzle 8 is formed by forming a hole in a metal plate by etching or the like. Further, the piezoelectric element 81 is provided to each nozzle 8. The driver 7 applies a voltage to the piezoelectric element 81 that ejects ink among the controlled piezoelectric elements 81 according to the control data. For example, the control unit 5 (image processing unit 6) transmits to each driver 7 information indicating operation of each nozzle 8 in one ejection drive (presence or absence of ejection, information indicating density, and control data). Each driver 7 applies a voltage to the piezoelectric element 81 corresponding to the nozzle 8 to eject ink, based on the information indicating operation of each nozzle 8. As a result, the shape of the piezoelectric element 81 is deformed by the applied voltage, and hence a pressure is applied to a channel (not shown) to supply ink to the nozzle 8. Thus, the pressure to the channel propagates so that the ink is ejected from the nozzle 8.

In addition, each driver 7 can change the voltage to be applied to the piezoelectric element 81. For example, it is possible to set the voltage to be applied to the piezoelectric element 81 to be smaller than a reference voltage to be applied to the piezoelectric element 81. In this way, the driver 7 can adjust ink ejection speed and ejection amount with respect to reference ink ejection speed and ejection amount so that the dots have different densities.

(Structure of Image Processing Unit 6)

Figure 5:
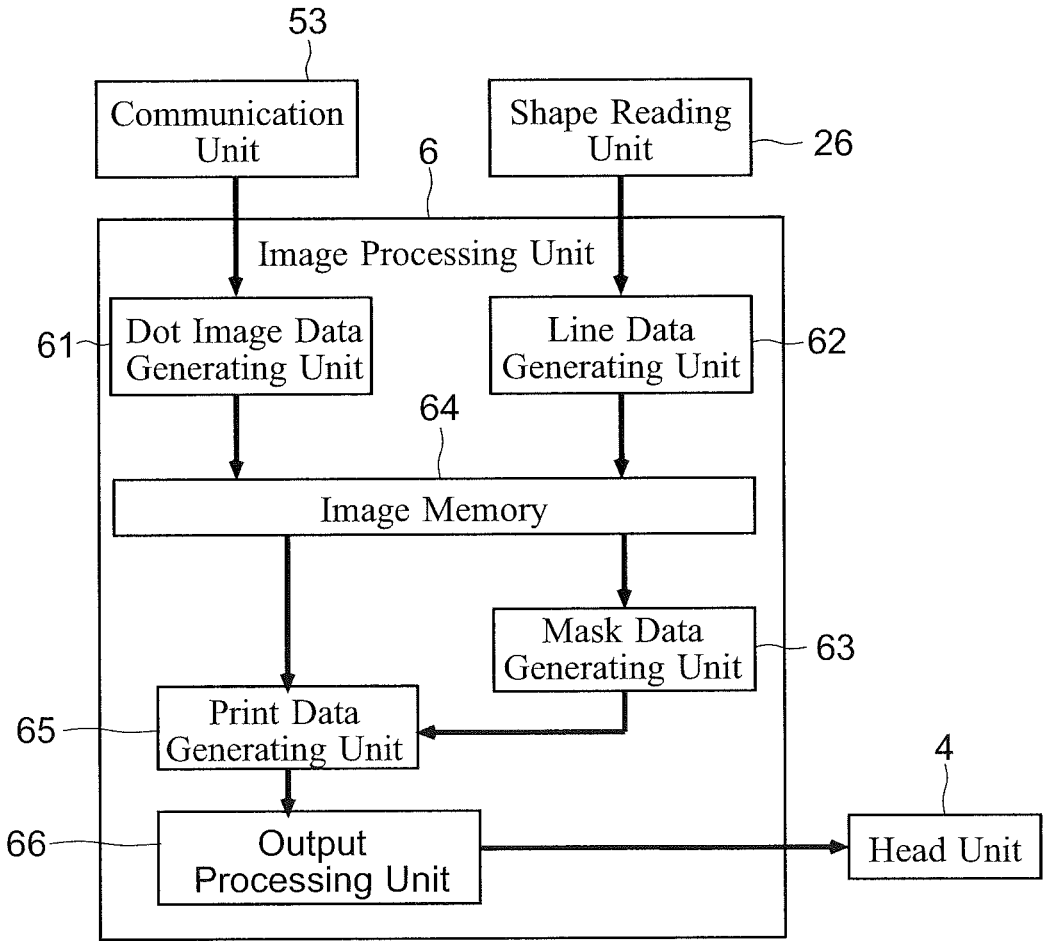
FIG. 5 is a block diagram showing an example of an image processing unit.

Next, an example of a structure of the image processing unit 6 is described with reference to the drawings. FIG. 5 is a block diagram showing an example of the image processing unit 6.

As described above, the communication unit 53 receives print data containing contents to be printed by the printer 100 and setting information from the computer 200 or the like. Further, the image processing unit 6 includes a dot image data generating unit 61, a line data generating unit 62, a mask data generating unit 63, an image memory 64, and a print image data generating unit 65.

The dot image data generating unit 61 generates bitmap format image data based on contents described in page description language contained in the print data. In other words, the dot image data generating unit 61 generates dot image data in which each pixel has a pixel value indicating density.

The dot image data generated by the dot image data generating unit 61 is stored in the image memory 64. Note that it is possible that the image data is stored in the image memory 64 without using the dot image data generating unit 61 when the image data of the dot image format is received from the computer 200 or the like. Note that it is supposed that the image memory 64 has not only a function as the storage unit but also a function as a memory controller. Alternatively, the memory controller may be provided separately.

The line data generating unit 62 generates line data indicating a shape of the paper sheet P one by one line based on the signals from the optical sensors Os of the shape reading unit 26. The line data is data of each one line and is binary data having an area value of each area Ar included in the one line. Note that the line data is stored in the image memory 64 together with positional information in the conveying direction of the paper sheet P.

The mask data generating unit 63 generates mask data, which specifies an area to which ink is not applied in printing, based on the line data. Note that the mask data is data of each one line similarly to the line data and has the same structure (line width and number of areas) as the line data. The mask data generated by the mask data generating unit 63 is stored in the image memory 64 together with the positional information within the paper sheet P.

The image memory 64 inputs one line dot data corresponding to the mask data of the stored dot image data and the mask data to the print data generating unit 65. The print data generating unit 65 generates the print image data, which specifies an ejection inhibition part to which ink is not ejected, with respect to the one line dot data.

The print image data generated by the print data generating unit 65 is input to an output processing unit 66 one by one line. Note that the image memory 64 may store a certain amount (e.g. one page) of the print image data generated by the print data generating unit 65 and transmit the same to the output processing unit 66.

The output processing unit 66 generates control data for controlling timing for operation of the head unit 4 based on the print image data. The control data contains information such as ink ejection timing of each nozzle 8 of the head unit 4, ejection amount, areas to which ink is not ejected. The control data is sent to the head unit 4 one by one line in synchronization with conveyance of the paper sheet P. Further, the head unit 4 operates the nozzle 8 based on information contained in the control data, so as to eject ink to the paper sheet P one by one line. The control data is transmitted to the head unit 4 at timing in synchronization with conveyance of the paper sheet P. In this way, the head unit 4 forms an image on the paper sheet P.

(Generation of Print Image Data)

Figures 6, 7:
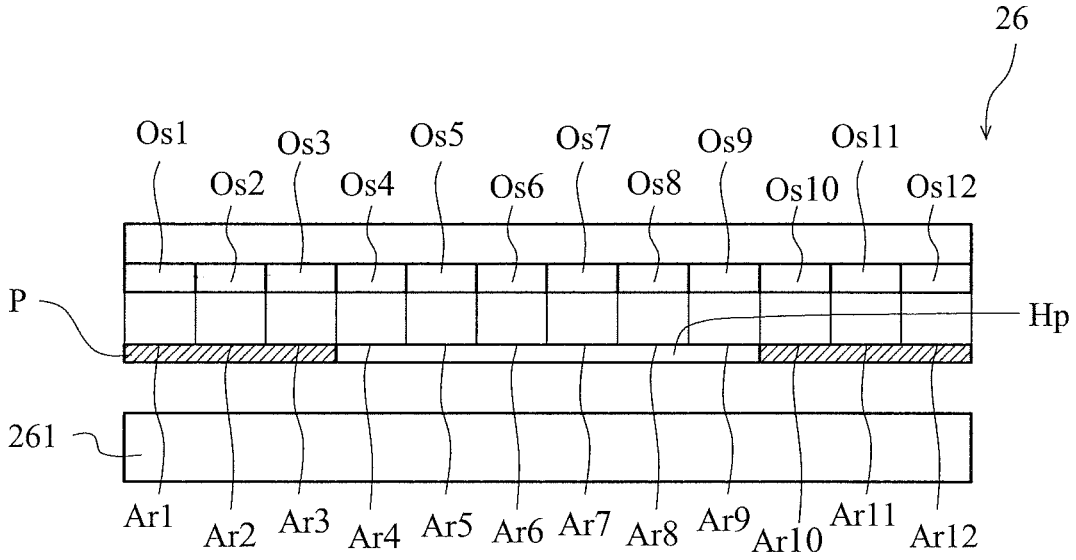
FIG. 6 is a cross-sectional side view showing a state of the shape reading unit that is reading a shape of a paper sheet.
FIG. 7 is a diagram showing line data of the paper sheet shown in FIG. 6.

Next, with reference to the drawings, an example of a method for generating print image data of the printer 100 according to the embodiment of the present disclosure is described. FIG. 6 is a cross-sectional side view showing a state where the shape reading unit 26 reads a shape of the paper sheet P. FIG. 7 is a diagram showing line data of the paper sheet P shown in FIG. 6. Note that it is supposed that FIG. 6 indicates that a half length in the main scanning direction of the paper sheet P is detected.

In FIG. 6, the left and right direction of the paper sheet is the main scanning direction. Further, the shape reading unit 26 shown in FIG. 6 includes 12 optical sensors Os in the main scanning direction, and the optical sensors Os are denoted by numerals 1 to 12 for convenience sake. In addition, as shown in FIG. 6, the paper sheet P is provided with a punch hole Hp.

FIG. 6 shows an operation of the shape reading unit 26 that reads a shape of a part where the punch hole Hp is formed. As shown in FIG. 6, there is the paper sheet P between the light source 261 and the optical sensors Os1 to Os3 and Os10 to Os12. Therefore, light from the light source 261 is blocked by the paper sheet P and does not enter or hardly enter the optical sensors Os1 to Os3 and Os10 to Os12. On the other hand, the punch hole Hp is positioned between the light source 261 and the optical sensors Os4 to Os9, and there is no paper sheet P between them. Therefore, most of the light from the light source 261 is not blocked by the paper sheet P and enters the optical sensors Os4 to Os9. The optical sensor usually outputs a signal having an amplitude (voltage) proportional to light intensity. Therefore, the signals from the optical sensors Os1 to Os3 and Os10 to Os12 have smaller amplitudes than the signals from the optical sensors Os4 to Os9.

Further, the signals from the optical sensors Os1 to Os12 are sent to the line data generating unit 62. The line data generating unit 62 compares the signals from the optical sensors Os1 to Os12 with a threshold value so as to digitize the signals from the optical sensors Os into binary data so that the line data is generate. When the signal is higher than the threshold value, the line data generating unit 62 determines that the light from the light source is not blocked by the paper sheet P, i.e. that the paper sheet P does not exists in the area Ar detected by the optical sensor Op that transmits the signal, and sets a value of the area Ar to zero. When the signal is lower than the threshold value, the line data generating unit 62 determines that the light from the light source is blocked by the paper sheet P, i.e., that the paper sheet P exists in the area Ar detected by the optical sensor Op that transmits the signal, and sets a value of the area Ar to one. FIG. 7 shows line data as a result of detection of the paper sheet P shown in FIG. 6.

As shown in FIG. 7, the line data of one line of the paper sheet P detected in the state shown in FIG. 6 has an area value of one for the areas Ar1 to Ar3 and Ar10 to Ar12 and an area value of zero for the areas Ar4 to Ar9. Further, an area value of zero indicates a part where the paper sheet P does not exist, namely a part to which ink is not ejected. The shape reading unit 26 sequentially transmits the signals from the optical sensors Os1 to Os12 to the control unit 5 in accordance with conveyance of the paper sheet P. Further, together with the transmission, information of the detected line position in one paper sheet P is also transmitted to the line data generating unit 62. Note that the number of data transmission, time of transmission, lapse time from start of detection of one paper sheet P, or the like can be used as the detected line position information in the paper sheet P. In this example, the number of data transmission is used. Further, the line data generating unit 62 generates the line data one by one line according to conveyance of the paper sheet P.

For example, start time of detection of the paper sheet P is the first data transmission, and hence the number of transmission is set to one. Further, the length L of the detection range Sc in the conveying direction is a predetermined length, and hence the control unit 5 can determine which part of data in the paper sheet P the received signal is, based on the number of transmission. Further, the image memory 64 stores a database in which the line data and the number of transmission are associated with each other.

Figure 8:
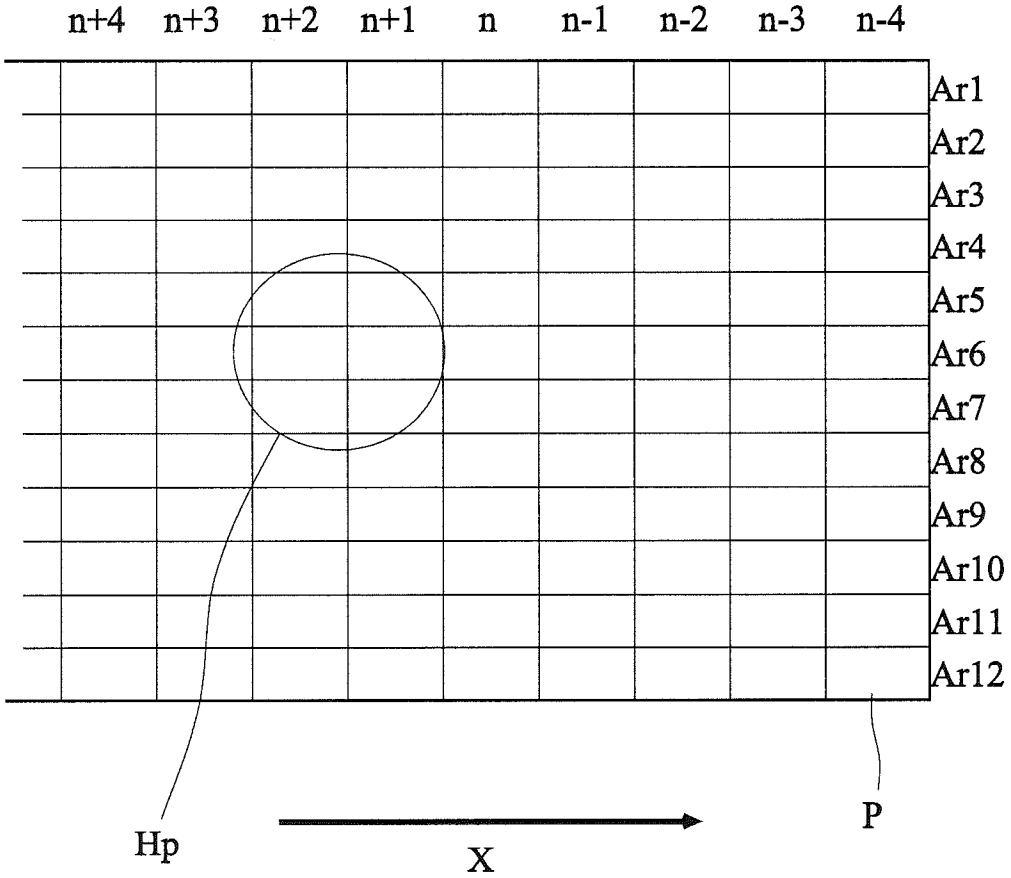
FIG. 8 is a diagram showing a paper sheet having a punch hole that is read by the shape reading unit.

Next, a method of generating the mask data is described with reference to the drawings. FIG. 8 is a diagram showing the paper sheet P with the punch hole Hp, which is read by the shape reading unit 26, and FIG. 9 is a diagram showing a database of line data of the paper sheet P shown in FIG. 8. As shown in FIG. 8, the punch hole Hp is formed in the n-th to (n+2)th lines in the paper sheet P. In addition, FIG. 9 shows the (n−4)th line to (n+3)th line data, but actually other line data before and after them may be included. Note that "−" indicates that the data is detected before the n-th line, and "+" indicates that the data is detected after the n-th line. In addition, FIG. 9 shows the (n−4)th to (n+3)th line data.

As shown in FIG. 8, the punch hole Hp is formed in the (n+1)th to (n+3)th lines in the paper sheet P. Further, a hole or the like through which ink passes is not formed in the (n−4)th to n-th lines and the (n+4)th and after lines. Therefore, as shown in FIG. 9, the areas Ar1 to Ar12 in the (n−4)th to n-th lines and the (n+4)th and after lines have an area value of one. On the other hand, the entire area Ar6 and major portions of the areas Ar5 and Ar7 form the punch hole Hp in the (n+1)th line. Therefore, the signals from the optical sensors Os5 to Os7 are larger than a threshold value, and area values of the areas Ar5 to Ar7 in the line data of the (n+1)th line are zero. In the same manner, the punch hole Hp is formed in the areas Ar4 to Ar8 of the (n+2)th line, and hence in the line data of the (n+2)th line, area values of the areas Ar1 to Ar3 and the areas Ar9 to Ar12 are one, and area values of the areas Ar4 to Ar8 are zero.

The (n+3)th line is described below. In the (n+3)th line, the punch hole Hp is formed in a part of the areas Ar5 to Ar7. As described above, the shape reading unit 26 outputs the signal having an amplitude that varies according to intensity of light detected by the optical sensors Os1 to Os12 in light emitted from the light source 261. Like the areas Ar5 to Ar7 of the (n+3)th line shown in FIG. 8, in case where major portions thereof are hidden by the paper sheet P, even if a part of the punch hole Hp is formed, a signal similar to that in case where the paper sheet exists is sent to the line data generating unit 62. Therefore, when the part where the punch hole Hp is formed is a narrow area like the areas Ar5 to Ar7 of the (n+3)th line, the area value is one.

Using such line data, it is possible to control so that ink is ejected from the nozzle in the area having an area value of one and is not ejected in the area having an area value of zero. However, as described above, in an area having a small ratio of the punch hole Hp to the area, the area value is one, and hence the ink is ejected in the area although the punch hole Hp exists in the area. Therefore, in the embodiment of the present disclosure, using the line data, the mask data, which is line data in which the ejection inhibition area for not ejecting ink is reset, is generated.

A method of generating the mask data is described below. FIG. 10 is a diagram showing a procedure for generating the n-th mask data based on the line data shown in FIG. 9.

For example, when generating the mask data for the n-th line, the mask data generating unit 63 reads, from the image memory 64, the (n−2)th and (n−1)th line data that are two line data just before the n-th line, and the (n+1)th and (n+2)th line data that are two line data just after the n-th line. Then, the mask data generating unit 63 calculates the logical conjunction (AND) of each area value of the areas Ar1 to Ar12 of all the line data of the (n−2)th to (n+2)th lines.

As shown in FIG. 10, the area value of the area Ar1 is one in all line data, and hence a result of the logical conjunction becomes one. In the same manner, in case of the area Ar4, the area value of the (n+2)th line is zero, and hence a result of the logical conjunction becomes zero. In this way, the value determined as a result of the logical conjunction of the areas Ar1 to Ar12 is generated as the mask data for the n-th line. As shown in FIG. 10, the mask data for the n-th line has an area value of one for the areas Ar1 to Ar3 and Ar9 to Ar12 and an area value of zero for the areas Ar4 to Ar8. Note that in the mask data, the area having an area value of zero is the ink ejection inhibition part to which ink is not ejected.

In other words, the mask data generating unit 63 determines a result of the logical conjunction of the area values of each area of the n-th line data and two line data detected before and after the n-th line data for generating the n-th mask data.

Further, the mask data generating unit 63 transmits the generated mask data to the print data generating unit 65. In this case, the image memory 64 transmits to the print data generating unit 65 also the dot image data of each line corresponding to the transmitted mask data. The dot image data contains information of a type of ink to be ejected for each dot, amount the ink, ejection timing, and the like, which are given as numerical values.

The print data generating unit 65 superposes the dot image data and the mask data of each line, so as to determine a result of the logical conjunction of a value of the dot image data matching with each area of the mask data and an area value of the each area: The area value of the mask data is zero or one, and hence a result of the logical conjunction is an original value of the dot image data or zero. In other words, the print image data is obtained by reflecting the area of the ink ejection inhibition part (having an area value of zero) in the mask data on the dot image data.

Then, the generated print image data is transmitted to the output processing unit 66. The output processing unit 66 generates the control data containing information of a type of ink to be ejected from each nozzle 8 of the head unit 4, amount of the ink, an ejection position, and the ejection inhibition area based on the print image data, and transmits the control data to the head unit 4. The head unit 4 ejects ink of a specific type and amount to a specific position based on the control data. In this case, control of not ejecting ink is also performed for a part to be the ejection inhibition part.

Figure 11:
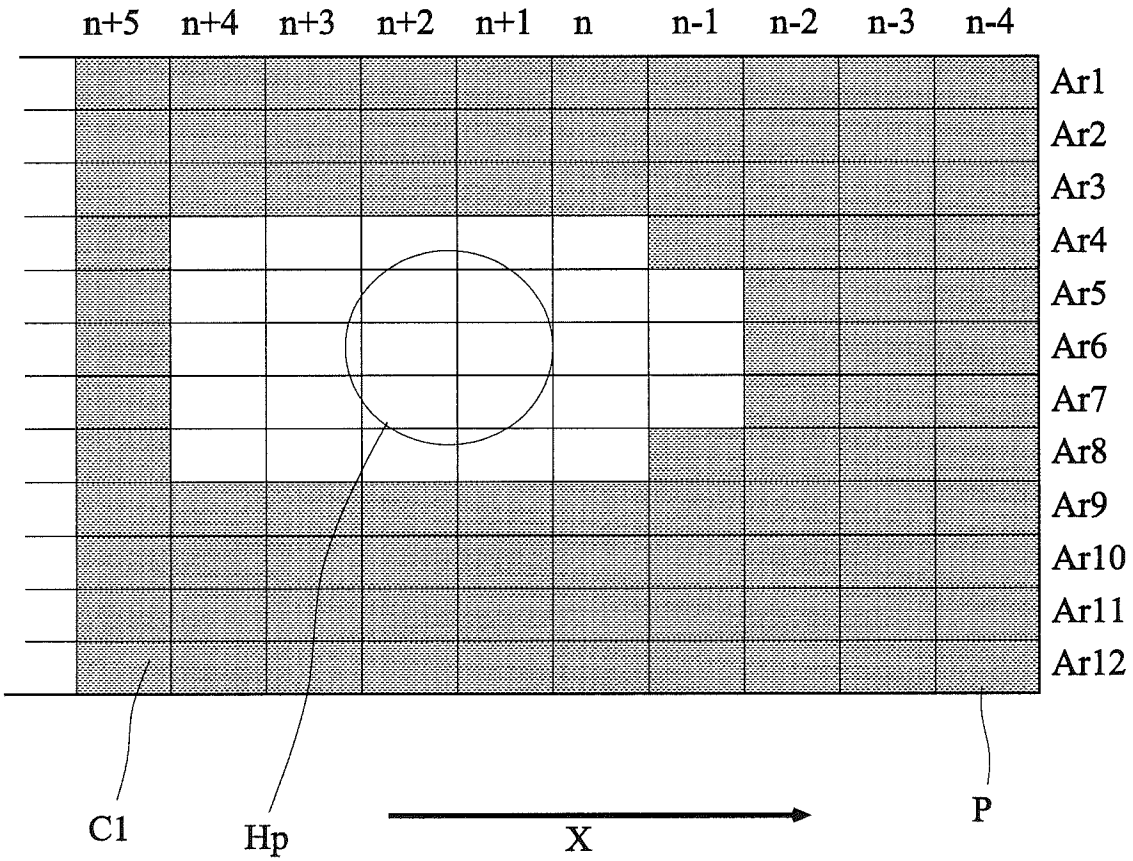
FIG. 11 is a diagram showing a state of the paper sheet on which an image is formed by the printer according to an embodiment of the present disclosure.

The image formed as above description is described with reference to the drawings. FIG. 11 is a diagram showing an image formation state on the paper sheet P by the printer 100 shown in the embodiment of the present disclosure. FIG. 11 shows an image printed in one color (first color C1 in this example) in one page.

FIG. 11 shows a printed state of the areas Ar1 to Ar12 in the individual lines. For example, in the (n−2)th line, the mask data is formed based on the (n−4)th to n-th line data. As shown in FIG. 9, the (n−4)th to n-th line data include no area having an area value of zero, and hence the mask data containing an area value of zero is not generated. On the other hand, in the (n−1)th line, the mask data is formed based on the (n−3)th to (n+1)th line data. As shown in FIG. 9, area values of the areas Ar5 to Ar7 of the (n+1)th line data are zero, and hence the mask data of the (n−1)th line is the mask data having an area value of zero in the areas Ar5 to Ar7. Further, when the mask data of the (n−1)th line is used to generate the print image data, ink is not ejected to the areas Ar5 to Ar7 in the (n−1)th line of the paper sheet P. In the same manner, the mask data of the n-th to (n+4)th line have an area value of zero in the areas Ar4 to Ar9, because the logical conjunction is determined among the area values of the areas of the (n+2)th line data in each line. Therefore, in the n-th to (n+4)th lines of the paper sheet P, ink is not ejected to the areas Ar4 to Ar9. Further, in the (n+5)th line, the line two lines before becomes the (n+3)th line, and the logical conjunction is not calculated between itself and the line data of the (n+2)th line, and hence the area value becomes one in all areas.

As described above, by reading a plurality of binarized line data in a reading order and by determining a result of the logical conjunction of the area values of the line data, even if the paper sheet has a part through which ink passes (e.g. a part of a formed punch hole), it is possible to prevent ink from being ejected to the part.

In the embodiment of the present disclosure, a hole (e.g. a punch hole) formed in the paper sheet is exemplified and described as the ejection inhibition part to which ink is not ejected, but this is not a limitation. For example, in the shape reading unit, it is possible to dispose the light source on the same side as the optical sensor with respect to the paper sheet, and to detect a shape or a state of a surface of the paper sheet based on light intensity of reflected light. With this structure, it is possible to paste a member (e.g. a sticker) having a higher reflectance than the paper sheet to a part of the paper and not to eject ink to only the periphery of the part. In this case, by forming a part opposite to the detection range with respect to the paper sheet to be a mirror-like surface having a high optical reflectance, it is possible to control to inhibit ink ejection at the part where the high reflectance member is attached and the part of the hole.

Note that the mask data generating unit 63 in the embodiment of the present disclosure transmits the mask data to the print data generating unit 65 just after generating the mask data, but this is not a limitation. For example, it is possible to transmit the generated mask data to the print data generating unit 65 after storing the same temporarily in the image memory 64. The amount of storage may correspond to one page, for example. In addition, in the embodiment of the present disclosure, the length L in the conveying direction of the detection range in which the shape reading unit reads a shape of the paper sheet is described to be the same as the printing range of one printing operation by the head unit 4, but they may be different sizes. In case of different sizes, it is preferred that at least the print image data should be temporarily stored in the image memory 64, and the print image data having a size corresponding to the printing range of one printing operation by the head unit 4 should be transmitted to the output processing unit 66. In addition, it is possible to store the mask data in the image memory 64, and to transmit the mask data having a size corresponding to the printing range of one printing operation by the head unit 4 together with the dot image data to the print data generating unit 65.

The head unit 4 described above has a structure in which the nozzles 8 are arranged in a direction perpendicular to the conveying direction of the paper sheet P, but this is not a limitation. For example, it is possible to adopt a structure in which the head unit 4 ejects ink from the nozzle 8 while it is moved (scans) in the direction perpendicular to the conveying direction of the paper sheet P.

An example of the inkjet recording apparatus according to the present disclosure may include a shape reading unit that reads a shape of a conveyed recording medium by dividing it into read lines, each of which has a certain length in a conveying direction of the recording medium and has a plurality of areas divided in a direction perpendicular to the conveying direction, a line data generating unit that generates line data based on information of the shape of the recording medium read by the shape reading unit, a head unit that ejects ink to the recording medium conveyed to a print range having a predetermined length in the conveying direction, a mask data generating unit that specifies an ejection inhibition part to which ink is not ejected from each of the plurality of line data generated continuously, so as to generate mask data in which information of all the specified ejection inhibition parts is added to one line data, and a print image data generating unit that combines the dot image data and the mask data so as to generate print image data in which a location to which the head unit does not eject ink is specified with respect to the dot image data.

With this structure, the ejection inhibition part to which ink is not ejected can be extended in the conveying direction of the recording medium (a sub-scanning direction viewed from the head unit). In this way, it is possible to prevent ink from being ejected to the inside of the inkjet recording apparatus through a hole or the like of the recording medium. In this way, contamination inside the inkjet recording apparatus is suppressed, and contamination of the recording medium is suppressed.

In the structure described above, the mask data generating unit may generate the mask data of the read line to be processed from plurality of line data including line data of the read line to be processed, line data of a read line at timing before the line data of the read line to be processed, and line data of a read line after the line data of the read line to be processed. With this structure, the ejection inhibition part of the read line to be processed is formed by using a result of the line data of the before and after read lines, and hence it is possible to prevent formation of a part to which ink is ejected although the ejection inhibition part is formed in the part.

In the structure described above, the print image data generating unit may generate divided image data by dividing the dot image data into parts corresponding to the read lines, and generates the print image data in which the divided image data and the mask data are combined. With this structure, necessary mask data can be reduced so that the memory can be downsized.

In the structure described above, an area value of one or zero is set to each of the all areas of the mask data. The area corresponding to the ejection inhibition part has an area value of zero, and the area to which ink is ejected has an area value of one. The print image data generating unit superposes the divided image data and the mask data, and generates print image data that is a result of calculation of the logical conjunction between a pixel value of the divided image data matching with an area of the mask data and an area value of the area. The head unit refers to the print image data and does not eject ink to a part having a pixel value of zero. In this way, the process can be simplified.

In the structure described above, the head unit may include a plurality of nozzles for ejecting ink, and the nozzles may be arranged in a direction crossing the conveying direction of the recording medium.

In the structure described above, the head unit may move reciprocatingly in a direction perpendicular to the conveying direction of the recording medium.

In the structure described above, the ejection inhibition part may be formed based on a punch hole formed in the recording medium.

Note that though the embodiment described above is a preferred example of the present disclosure, the present disclosure is not limited to this, and can be variously modified or changed within the scope of the present disclosure without deviating from the spirit thereof.

The present disclosure can be applied to an inkjet recording apparatus that ejects ink from a nozzle and prints on a paper sheet having a part such as a punch hole through which ink passes.

What is claimed is:

1. An inkjet recording apparatus comprising:

a shape reading unit configured to read a shape of a conveyed recording medium by dividing it into read lines, each of which has a certain length in a conveying direction of the recording medium and has a plurality of areas divided in a direction perpendicular to the conveying direction;

a line data generating unit configured to generate line data based on information of the shape of the recording medium read by the shape reading unit;

a head unit configured to eject ink to the recording medium conveyed to a print range having a predetermined length in the conveying direction;

a mask data generating unit configured to specify, as an election inhibition area, an area which includes an ejection inhibition part to which ink is not ejected in each of the plurality of line data generated continuously, so as to generate mask data in which information of all the specified ejection inhibition areas is added to one line data; and a print image data generating unit configured to combine the dot image data and the mask data so as to generate print image data in which an area to which the head unit does not eject ink is specified with respect to the dot image data;

wherein the shape reading unit is disposed on an upstream side of the head unit in the conveying direction of the recording medium; and wherein the mask data generating unit generates the mask data of the read line to be processed from the plurality of line data including line data of the read line to be processed, line data of a read line at a timing before the line data of the read line to be processed, and line data of a read line after the line data of the read line to be processed.

2. The inkjet recording apparatus according to claim 1, wherein the mask data generating unit generates the mask data of the read line to be processed from plurality of line data including line data of the read line to be processed, line data of a read line at timing before the line data of the read line to be processed, and line data of a read line after the line data of the read line to be processed.

3. The inkjet recording apparatus according to claim 1, wherein the print image data generating unit generates the divided image data by dividing the dot image data into parts corresponding to the read lines, so as to generate the print image data in which the divided image data and the mask data are combined.

4. The inkjet recording apparatus according to claim 1, wherein an area value of one or zero is set to each of the all areas of the mask data, the area corresponding to the ejection inhibition part has an area value of zero, and the area to which ink is ejected has an area value of one, the print image data generating unit superposes the divided image data and the mask data, and generates print image data that is a result of calculation of the logical conjunction between a pixel value of the divided image data matching with an area of the mask data and an area value of the area, and the head unit refers to the print image data and does not eject ink to a part having a pixel value of zero.

5. The inkjet recording apparatus according to claim 1, wherein the head unit includes a plurality of nozzles for ejecting ink, and the nozzles are arranged in a direction crossing the conveying direction of the recording medium.

6. The inkjet recording apparatus according to claim 1, wherein the head unit moves reciprocatingly in a direction perpendicular to the conveying direction of the recording medium.

7. The inkjet recording apparatus according to claim 1, wherein the ejection inhibition part is formed based on a punch hole formed in the recording medium.

* * * * *